US011596956B2

(12) United States Patent
Luo

(10) Patent No.: US 11,596,956 B2
(45) Date of Patent: Mar. 7, 2023

(54) OSCILLATING SPRINKLER

(71) Applicant: K-RAIN MANUFACTURING CORP., Riviera Beach, FL (US)

(72) Inventor: Danhui Luo, Lake Worth, FL (US)

(73) Assignee: K-RAIN MANUFACTURING CORP., Riviera Beach, FL (US)

( * ) Notice: Subject to any disclaimer, the term of this patent is extended or adjusted under 35 U.S.C. 154(b) by 0 days.

(21) Appl. No.: 16/683,821

(22) Filed: Nov. 14, 2019

(65) Prior Publication Data

US 2021/0146383 A1 May 20, 2021

(51) Int. Cl.

*B05B 3/04* (2006.01)
*B05B 3/16* (2006.01)
*B05B 3/10* (2006.01)

(52) U.S. Cl.

CPC ..... *B05B 3/0431* (2013.01); *B05B 3/16* (2013.01); *B05B 3/0477* (2013.01); *B05B 3/1035* (2013.01)

(58) Field of Classification Search

CPC ..... B05B 3/0431; B05B 3/16; B05B 3/0477; B05B 3/1035
USPC ..... 239/242
See application file for complete search history.

(56) References Cited

U.S. PATENT DOCUMENTS 3,921,912 A * 11/1975 Hayes ..... B05B 15/654 239/242
4,568,024 A * 2/1986 Hunter ..... B05B 3/0431 239/242
4,927,082 A * 5/1990 Greenberg ..... B05B 3/0404 239/230
5,148,991 A * 9/1992 Kah, Jr. ..... B05B 3/16 239/242
6,109,545 A * 8/2000 Kah, Jr. ..... B05B 3/14 239/242
6,209,801 B1 * 4/2001 Kearby ..... B05B 3/0481 239/206
7,287,712 B2 * 10/2007 Kah, Jr. ..... B05B 3/0431 239/206
8,567,698 B2 * 10/2013 Kah, Jr. ..... B05B 3/0431 239/206
9,120,111 B2 * 9/2015 Nations ..... B05B 3/0436
10,029,265 B2 * 7/2018 Bell ..... B05B 15/74
10,464,083 B2 * 11/2019 Onofrio ..... B05B 3/007

* cited by examiner

*Primary Examiner* — Arthur O. Hall
*Assistant Examiner* — Kevin Edward Schwartz
(74) *Attorney, Agent, or Firm* — Amster, Rothstein & Ebenstein LLP

(57) ABSTRACT

An oscillating sprinkler includes a turbine operatively connected to a movable gear cage that is biased into either a first position or a second position using three torsion springs to drive rotation of a nozzle housing.

16 Claims, 12 Drawing Sheets

OSCILLATING SPRINKLER

BACKGROUND

Field of the Disclosure

The present invention relates to an oscillating sprinkler including a rotating nozzle head driven by a transmission in two directions using spring bias to keep the transmission engaged in an operative position.

Related Art

It is well known that maintaining a continuous bias on a gear cage of a reversing transmission is an important consideration in oscillating sprinklers. These gear cages typically shift to allow a pair of drive gears carried on the gear cage assembly into and out of engagement with an output shaft ring gear when a reversing toggle moves over its reversing over-center position. Maintaining bias on the driving terminal gear prevents the gear from disengaging while stopping or starting the drive when the reversing toggle bias has been removed.

In the past, gear drives included a reversing gear drive in which the driving pinion always engaged the output gear with the reaction force on the driving terminal pinion gear to hold the driving gears in engagement with the driving input gear during driving in either direction. Input shaft torque is not applied to the shiftable gear cage to cause the gear cage to be disengaged in either of its driving positions.

Assignee's U.S. Pat. No. 5,148,991, issued Sep. 22, 1992, shows several oscillating sprinkler drive configurations in which a shiftable gear cage bias element continuously biases the gear cage towards one driving engagement direction or the other until the gear cage is shifted beyond the over-center position. The entire content of U.S. Pat. No. 5,148,991 is hereby incorporated by reference herein. This design, however suffers from several drawbacks. The springs used in these designs are subject to failure even during normal use because of fatigue. Further, spring force of the springs involved is limited. Finally, it is not uncommon for springs to pop out of place during operation.

Accordingly, it would be desirable to provide an oscillating sprinkler including a transmission that avoids these and other problems.

SUMMARY

It is an object of this invention to provide an oscillating sprinkler with a transmission for alternately driving an output gear to oscillate the oscillating sprinkler, by one driving gear and then another, with multiple torsion springs provided to prevent the transmission from being placed in an "off", or inoperable position where neither driving gear is positioned to drive the output gear upon starting.

As oscillating sprinkle according to an embodiment of the present disclosure includes a sprinkler housing including an inlet for connection to a supply of water; a nozzle assembly mounted in the body and configured to directing water out of the sprinkler, said nozzle assembly in fluid connection with the sprinkler housing; an output shaft mounted in the housing and connected to the nozzle assembly; a drive assembly mounted in the housing and connected to the output shaft to rotate the output shaft and the nozzle assembly, the drive assembly including: a movable gear cage; a toggle connected to the movable gear cage for changing the direction of rotation of the output shaft; a first drive gear mounted on one side of the movable gear cage configured to rotate the nozzle assembly in a first direction and a second drive gear mounted on a second side of the movable gear cage and configured to drive the nozzle assembly in a second direction, opposite the first direction, the movable gear cage configured to hold the first gear in driving engagement with the output shaft in a first position until the other drive gear is moved into the second position where it is in driving engagement with the output shaft; a pair of extensions rotatable with the output shaft and configured to engage the toggle and to move the movable gear cage to change the direction of rotation of the output shaft, and an over-center torsion spring positioned to bias the movable gear cage in at least one of the first position and the second position to prevent the movable gear cage from stalling in between the first position and the second position.

In embodiments, the oscillating sprinkler includes a first torsion spring provided on one side of the over-center torsion spring; a second torsion spring positioned on a second side of the over-center torsion spring, the first torsion spring and the second torsion spring biasing the movable gear cage into the first position when the first drive gear is engaged and into the second position when the second drive gear is engaged; the first torsion spring and the second torsion spring including at least one lateral projection formed at a bottom thereof, at least one of a first lateral projection of the first torsion spring and a second lateral projection of the second torsion spring extending into a first slot formed below a top surface of a gear cage support surface on which the movable gear cage moves.

In embodiments, the position of at least one extension of the pair of extensions is adjustable to set an arc of rotation of the nozzle assembly.

In embodiments, the arc of rotation is adjustable between 0 and 360 degrees.

In embodiments, the output shaft comprises an inner ring with a plurality of teeth mounted thereon and the first drive gear and second drive gear engage the plurality of teeth to rotate the output shaft.

In embodiments, the over-center torsion spring includes a lower lateral protrusion that extends into a slot formed below the top surface of the surface supporting the movable gear cage.

In embodiments, the oscillating sprinkler includes a turbine assembly mounted in the sprinkler housing and in fluid communication with the supply of water, the turbine assembly including a rotating shaft connecter to the movable gear cage to provide for rotation of the output shaft.

In embodiments, the movable gear cage further comprises a common gear connected to the rotating shaft of the turbine and interacting with the first drive gear and the second drive gear.

An oscillating sprinkler in accordance with an embodiment of the present disclosure includes: a sprinkler housing including an inlet connected to a supply of water; a nozzle assembly configured to direct water out of the sprinkler; an output shaft mounted in the housing and connected to the nozzle assembly; a movable gear cage mounted in the housing and movably contacting the output shaft, the movable gear cage including: a toggle configured to change a direction of rotation of the output shaft; and a first drive gear on one side of a center position and a second drive gear on a second side of the center position, the first and second drive gears alternately engageable with the output shaft in a first position and a second position to rotate the nozzle assembly in opposite directions, wherein both the first drive gear and the second drive gear are out of engagement when the output shaft is in a center position between the first position and the second position; an over-center spring configured to bias at least one of the first drive gear and the second drive gear into engagement with the output shaft; two extensions rotatable with the output shaft for contacting the toggle to change the direction of rotation of the output shaft and move the movable gear cage over its center position; a first torsion spring provided on one side of the over-center torsion spring; and a second torsion spring positioned on a second side of the over-center torsion spring, the first torsion spring and the second torsion spring biasing the movable gear cage into the first position when the first drive gear is engaged and into the second position when the second drive gear is engaged; the first torsion spring and the second torsion spring including at least one lateral projection formed at a bottom thereof, at least one of a first lateral projection of the first torsion spring and a second lateral projection of the second torsion spring extending into a first slot formed below a top surface of a gear cage support surface on which the movable gear cage moves.

In embodiments, the over-center spring is a torsion spring.

In embodiments, the position of at least one extension of the two extensions is adjustable to set an arc of rotation of the nozzle assembly.

In embodiments, the arc of rotation is adjustable between 0 and 360 degrees.

In embodiments, the output shaft comprises an inner ring with a plurality of teeth mounted thereon and the first drive gear and second drive gear engage the plurality of teeth to rotate the output shaft.

In embodiments, the over-center torsion spring includes a lower lateral protrusion that extends into a slot formed below the top surface of the surface supporting the movable gear cage.

In embodiments, the oscillating sprinkler includes a turbine assembly mounted in the sprinkler housing and in fluid communication with the supply of water, the turbine assembly including a rotating shaft connected to the movable gear cage to provide for rotation of the output shaft.

In embodiments, the movable gear cage further comprises a common gear connected to the rotating shaft of the turbine and interacting with the first drive gear and the second drive gear.

BRIEF DESCRIPTION OF THE DRAWINGS

The above and related objects, features and advantages of the present disclosure will be more fully understood by reference to the following detailed description of the preferred, albeit illustrative, embodiments of the present invention when taken in conjunction with the accompanying figures, wherein.

DETAILED DESCRIPTION OF THE EXEMPLARY EMBODIMENTS

Figure 1:
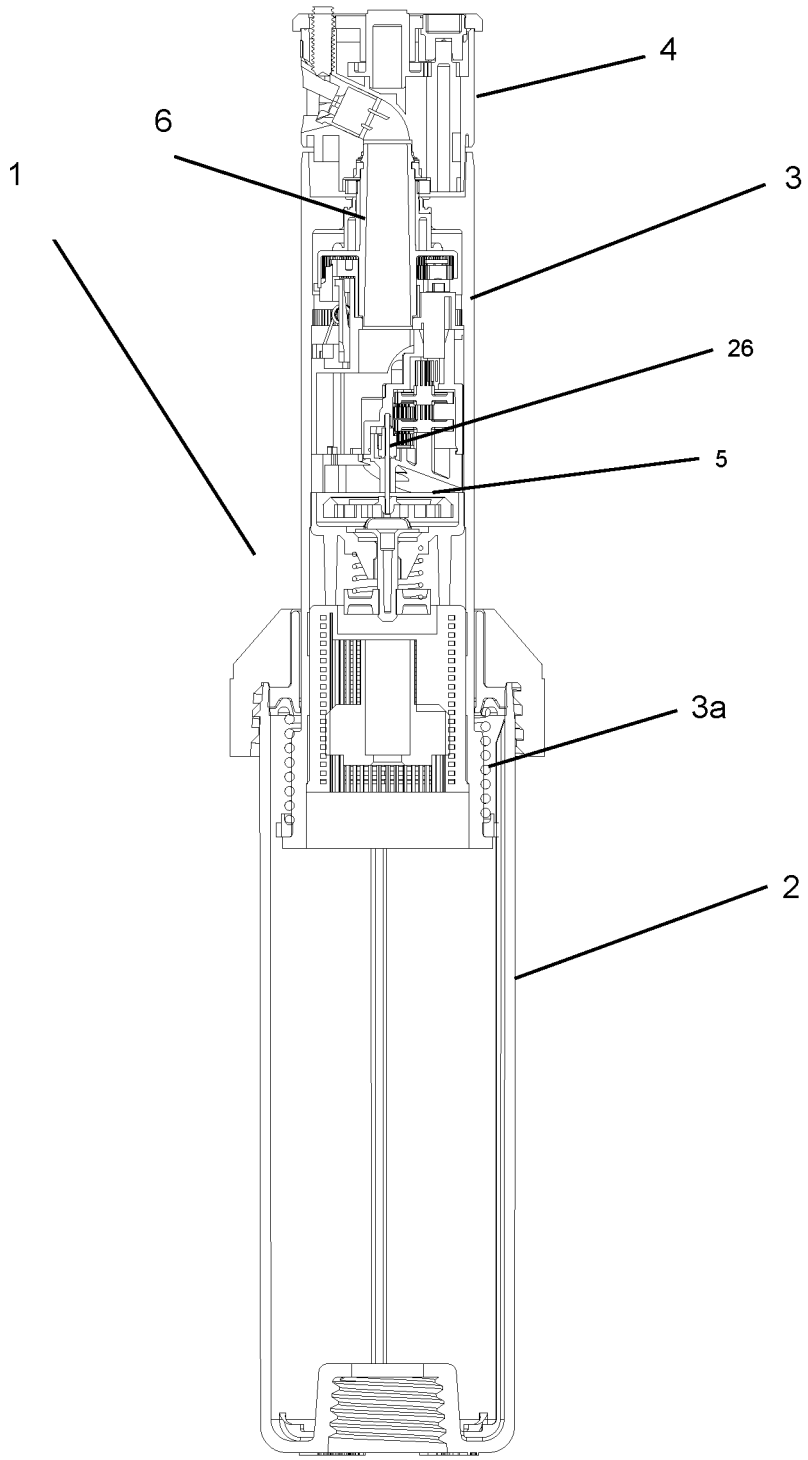
FIG. 1 illustrates an exemplary cross-sectional view of an oscillating sprinkler assembly including a transmission in accordance with an embodiment of the present application.
Figure 2:
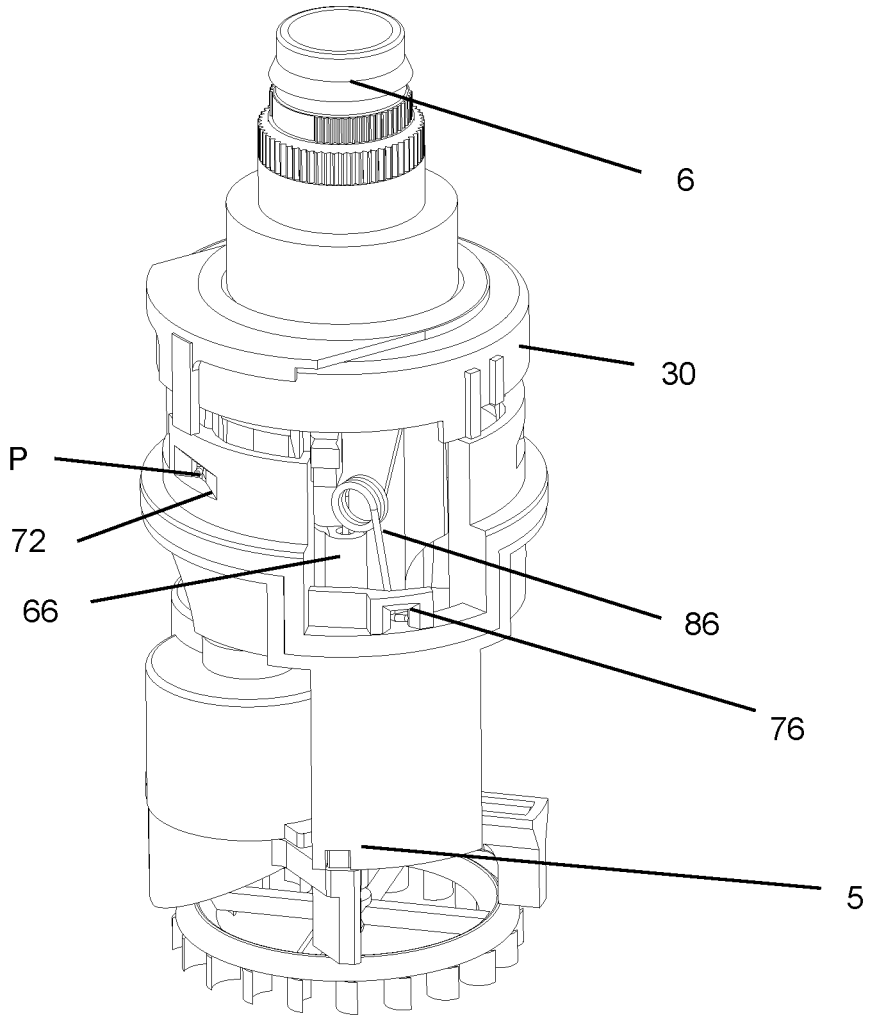
FIG. 2 illustrates a more detailed view of the drive portion of the oscillating sprinkler assembly of FIG. 1 in accordance with an embodiment of the present application.

FIG. 1 illustrates a cross-sectional view of an exemplary oscillating sprinkler assembly 1. In embodiments, the sprinkler assembly 1 may include a base or body 2 in which a riser 3 is movably mounted such that the riser is movable upward when acted on by water entering the base 2. In embodiments, water flows into the base 2 and pushes the riser 3 upward. When water is not flowing, the riser spring 3*a* biases the riser 3 into a retracted position.

Figure 3:
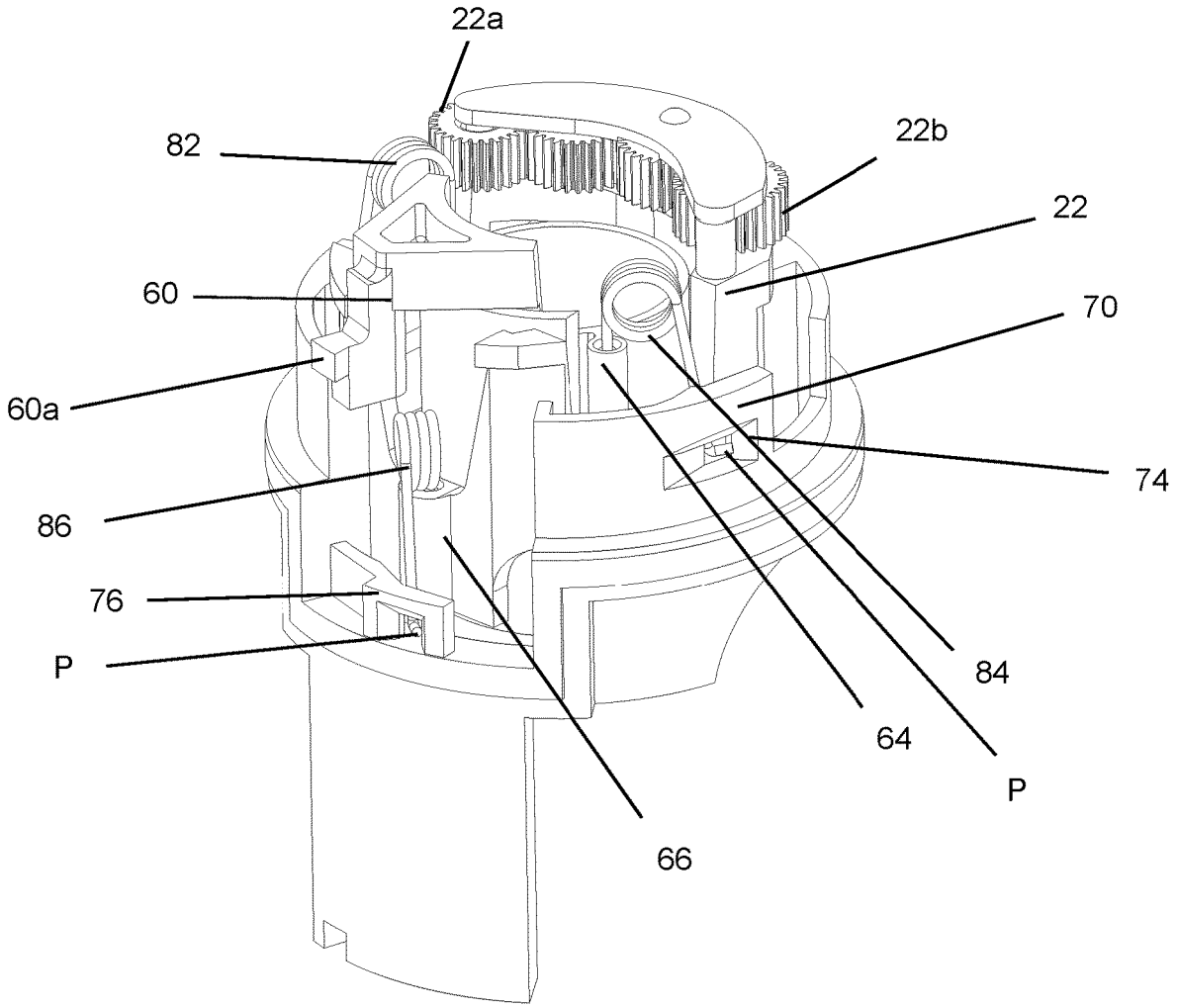
FIG. 3 illustrates a more detailed view of a gear cage of the oscillating sprinkler assembly of FIG. 1 in a first position in accordance with an embodiment of the present application.
Figure 9A:
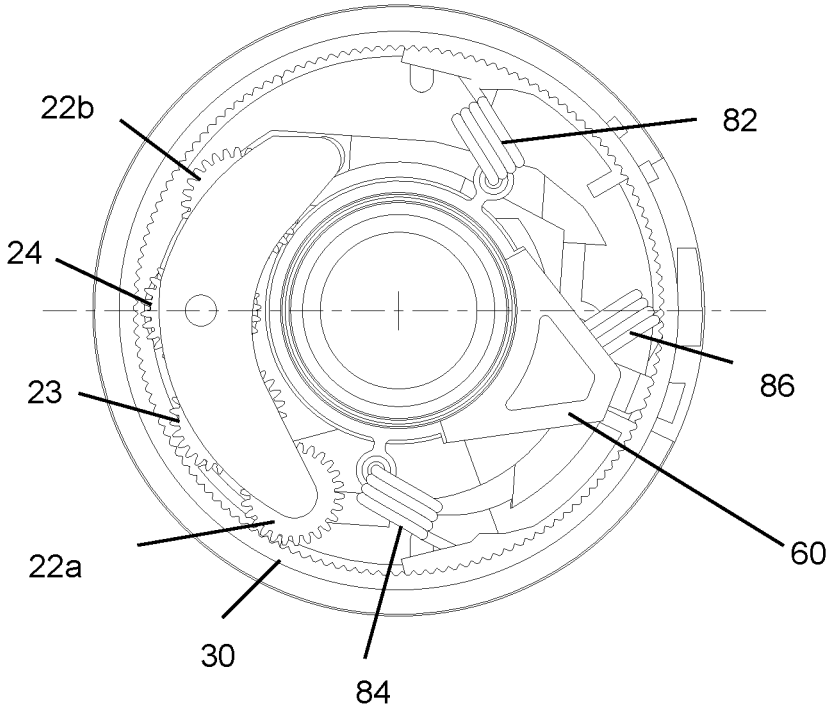
FIGS. 9A and 9B illustrates more detailed views of the driving gears in contact with a driving ring to rotate a nozzle housing of the oscillating sprinkler assembly of FIG. 1 in accordance with an embodiment of the present application.
Figure 9B:
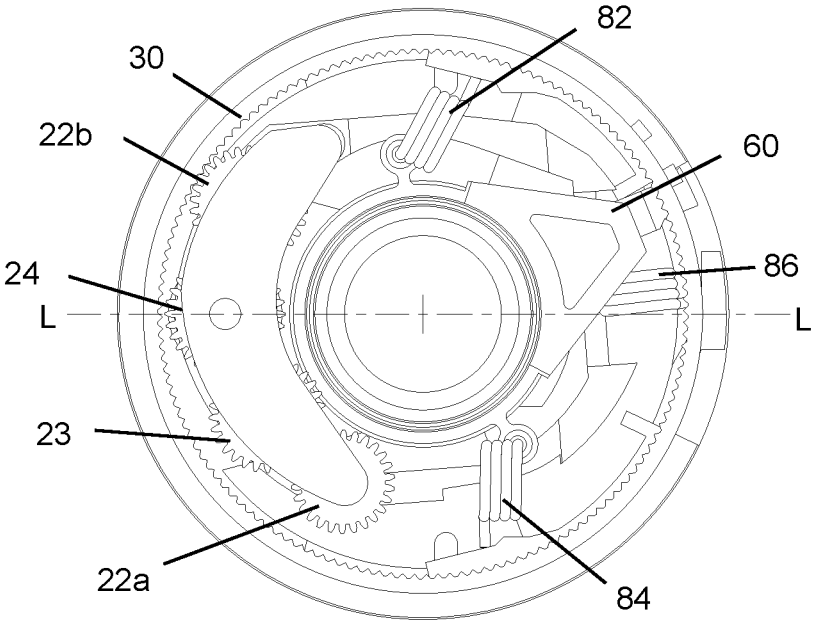

In embodiments, a turbine 5 is provided in the bottom portion of the riser 3 and is operatively connected via output shaft 6 to nozzle housing 4 mounted on a top of the riser 3. In embodiments, as water passes through the turbine 5, the turbine drives the drive gears 22*a*, 22*b* mounted in the gear cage 22 in opposite directions. In embodiments, the gear cage 22 is movable between a first position (see FIG. 3 for example) in which the first drive gear 22*a* contacts a drive ring 30 in a first direction (see FIG. 9A, for example). In embodiments, the drive ring 30 may be operatively connected to output shaft 6 connected to the nozzle housing 4 to rotate the nozzle housing. In embodiments, when the drive gear 22*a* is in contact with the ring 30 the housing 4 rotates in a first direction. In embodiments, when the drive gear 22*b* is in contact with the ring 30 (see FIG. 9B, for example) the nozzle housing 4 rotates in a second direction, opposite the first direction. In embodiments, the drive gears may be driven by one or more idle gear 23 which are, in turn driven by common gear 24. In FIGS. 9A and 9B, the common gear 24 may be rotated by a rotating shaft 26 that is operatively connected to the turbine 5. In operation, the common gear 24 rotates counter-clockwise, which rotates the gear 22*b* in the clockwise direction and the gear 22*a* in the counterclockwise direction via idler gear 23.

Figure 4:
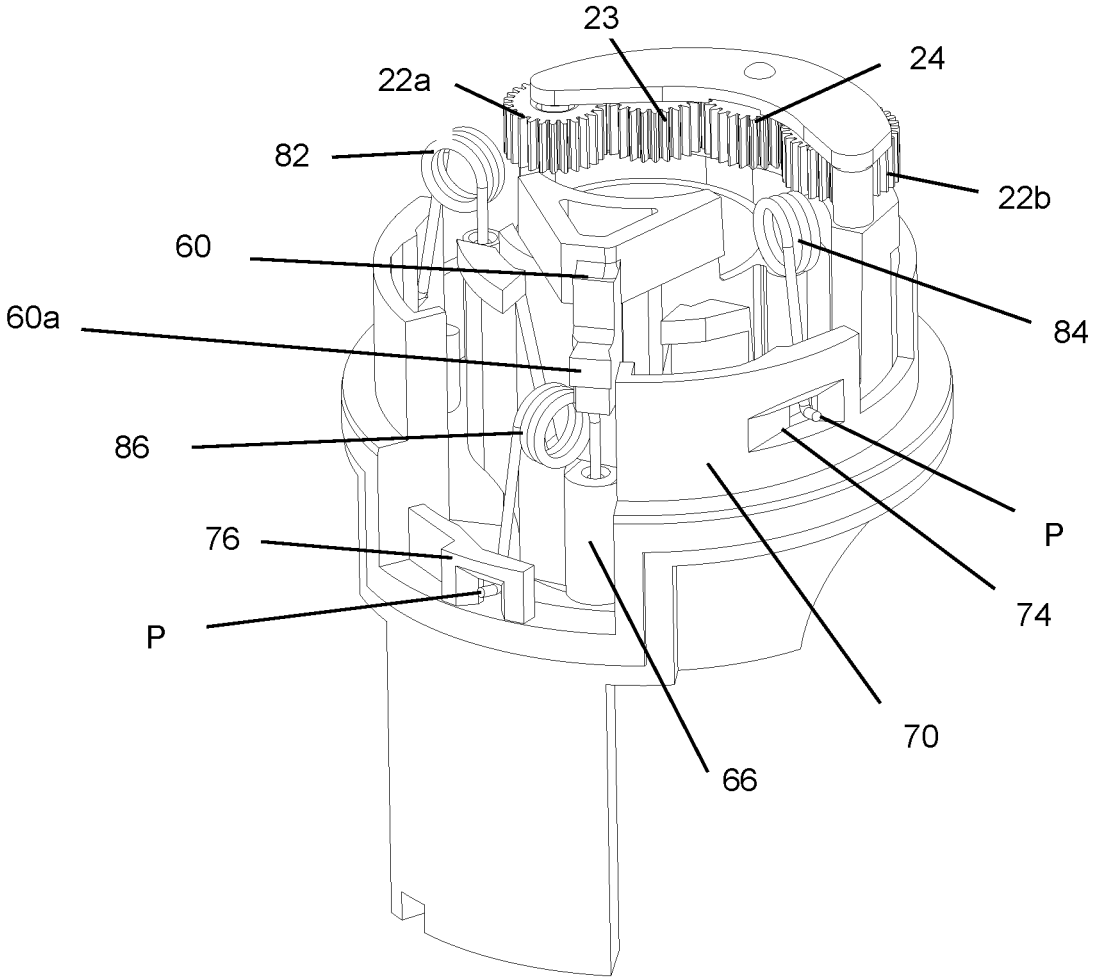
FIG. 4 illustrates a more detailed view of the gear cage of the oscillating sprinkler assembly of FIG. 1 in a second position in accordance with an embodiment of the present application.
Figure 5:
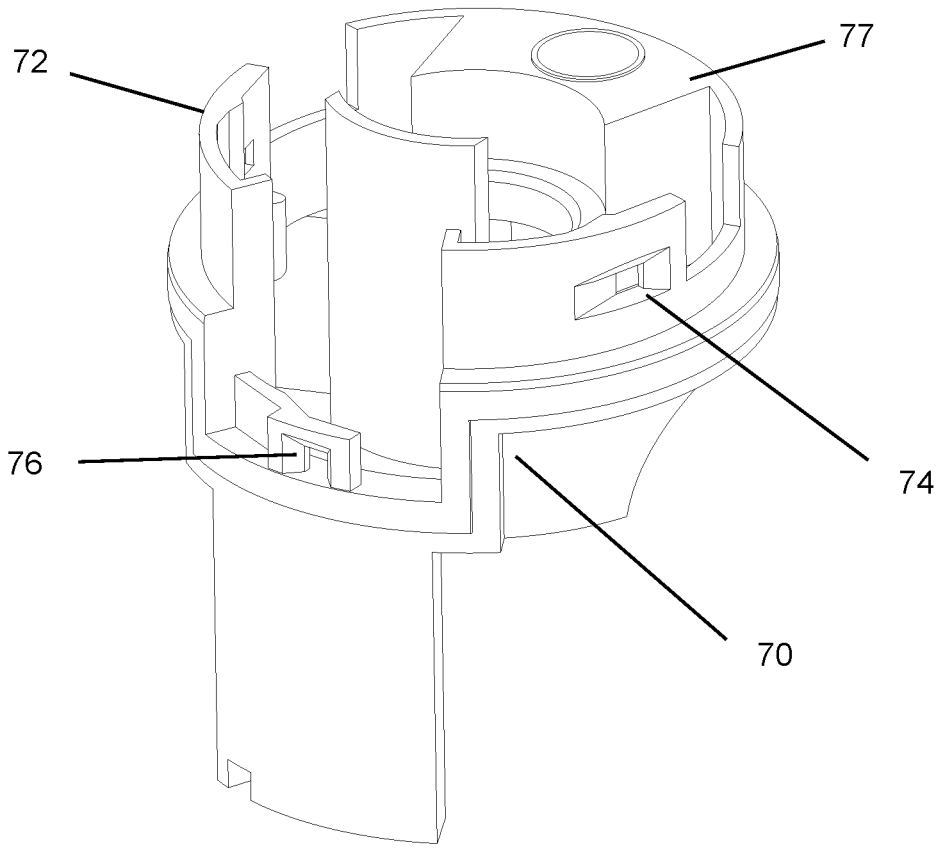
FIG. 5 illustrates a more detailed view of an upper gear box of the oscillating sprinkler assembly of FIG. 1 in accordance with an embodiment of the present application.
Figure 6:
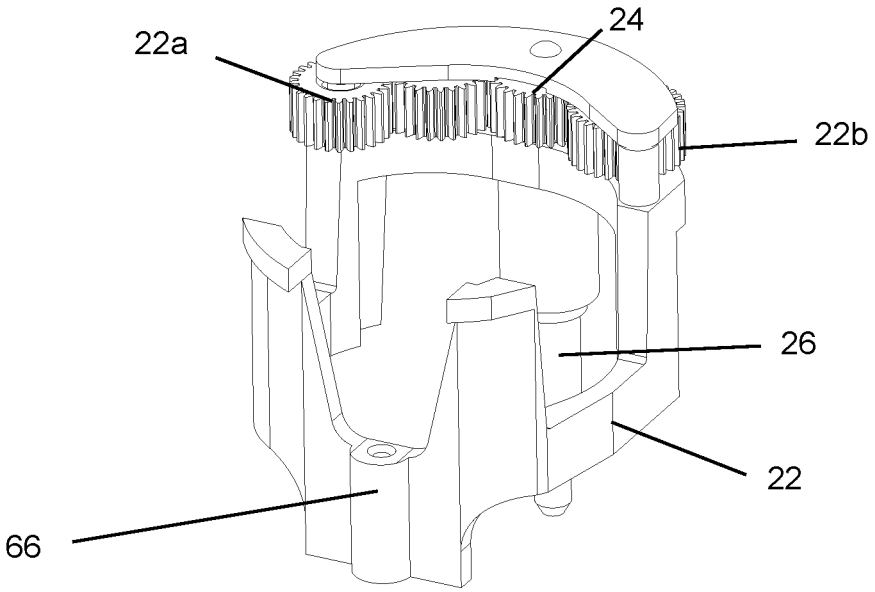
FIG. 6 illustrates a more detailed view of the gear cage of the oscillating sprinkler assembly of FIG. 1 in accordance with an embodiment of the present application.
Figure 7:
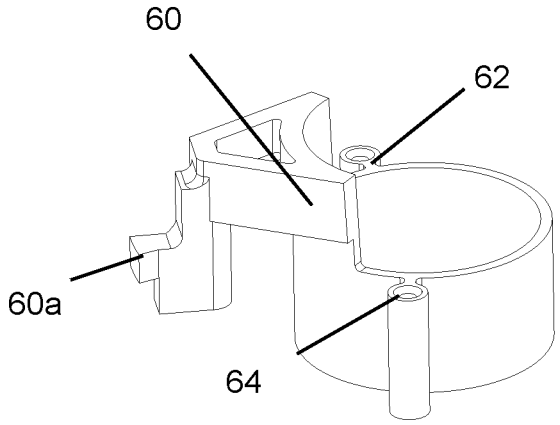
FIG. 7 illustrates a more detailed view of the toggle of the oscillating sprinkler assembly of FIG. 1 in accordance with an embodiment of the present application.
Figure 8:
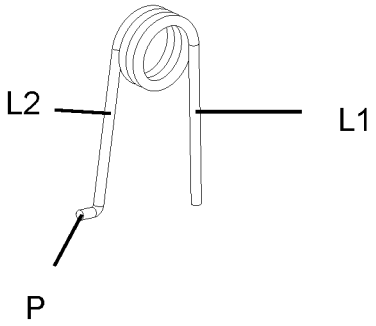
FIG. 8 illustrates an exemplary torsion spring for use in the oscillating sprinkler assembly of FIG. 1 in accordance with an embodiment of the present application.

In embodiments, the gear cage 22 is connected to a toggle 60. In embodiments, the toggle 60 is movable with the gear cage 22 from the first position to the second position. In embodiments, the toggle 60 includes a first spring opening 62 formed on one side thereof and a second spring opening 64 formed on an opposite side thereof. In embodiments, the first and second spring openings 62, 64 are provided opposite each other symmetrically such that a bias force applied by each against the toggle is substantially equal and in the same rotational direction. In embodiments, cooperating spring notches 72, 74 are provided in a protruding wall extending upward from the upper gear box 70 as can be seen in FIG. 6, for example. In embodiments, the notches 72, 74 are positioned below the gear support surface 77 of the gear cage 22. In embodiments, positioning the notches 72, 74 below the support surface 77 allows the torsion springs 82, 84 provides a distinct advantage in that it allows them to fit into a small space. If the springs 82 and 84 were provided above surface 77 it would be necessary to either use shorter, more complicated and more expensive torsion springs or a similar torsion spring with a taller ring gear 30. Using a taller ring gear 30, however, would require modifying surrounding components as well. In embodiments, a first spring element 82 is provided between the spring opening 62 and the notch 72 and a second spring element 84 is provided between the opening 64 and the notch 74. In embodiments, as indicated in FIG. 8, for example, the first and second spring elements 82, 84 are torsion springs. In embodiments, each torsion spring element 82, 84 includes a first leg L1 (see FIG. 8, for example) that is substantially straight and is received in the opening 62 or 64. In embodiments, each of the torsion springs 82, 84 includes a second leg L2 with a lateral projection P at a bottom end thereof that extends laterally into the respective notch 72, 74 to hold the springs in place. In embodiments, the notches 72, 74 are longer in a horizontal direction than in a vertical direction to allow for rotation of the lateral protrusions of the springs 82, 84 while limiting or eliminating vertical movement. In embodiments, the relative rotation of the spring elements 82, 84 is indicated by the change in orientation of the lateral portion P of the spring element 84, for example in FIG. 4 when compared to FIG. 3. This relative rotation of the spring elements 82, 84 takes place when the gear cage 22 changes positions. In embodiments, the first and second spring elements 82, 84 are used to bias the gear cage 22 into an active position, either the first position or the second position, such that at least one of the drive gears 22*a*, 22*b* is in contact with the ring 30.

In embodiments, the upper gear box 70 includes a third spring notch 76. The use of a torsion spring prevents accidental unseating of the spring, which is common in conventional leaf or omega shaped springs since the protrusion P extends into the notch 76 to hold it in place. The addition of the notch 76 provides the proper orientation of the torsion spring. In embodiments, the third spring notch 76 is provided between the notches 72, 74 on a side opposite the drive gears 22*a*, 22*b*. In embodiments, the gear cage 22 includes a spring opening 66, positioned on a side opposite the driving gears 22*a*, 22*b*. In embodiments, a center spring 86 (or over center spring) is provided between the notch 76 and the opening 66. In embodiments, the center spring 86 is a torsion spring similar to the torsion springs 82, 84 discussed above, where the straight leg L1 thereof is received in the opening 66 and the lateral portion P of the second leg L2 thereof extends into the notch 76. In embodiments, the third notch 76 is also longer in a horizontal direction than in a vertical direction to allow for rotation of the spring element 86, and the change in orientation of the lateral portion P thereof. In embodiments, this change in orientation can be seen in the change in orientation of the lateral protrusion P of the spring element 86 in FIG. 4 when compared to FIG. 3. In embodiments, the over center spring 86 biases the gear cage 22 into either the first position or the second position and prevents stalling in between the two positions.

Figure 9C:
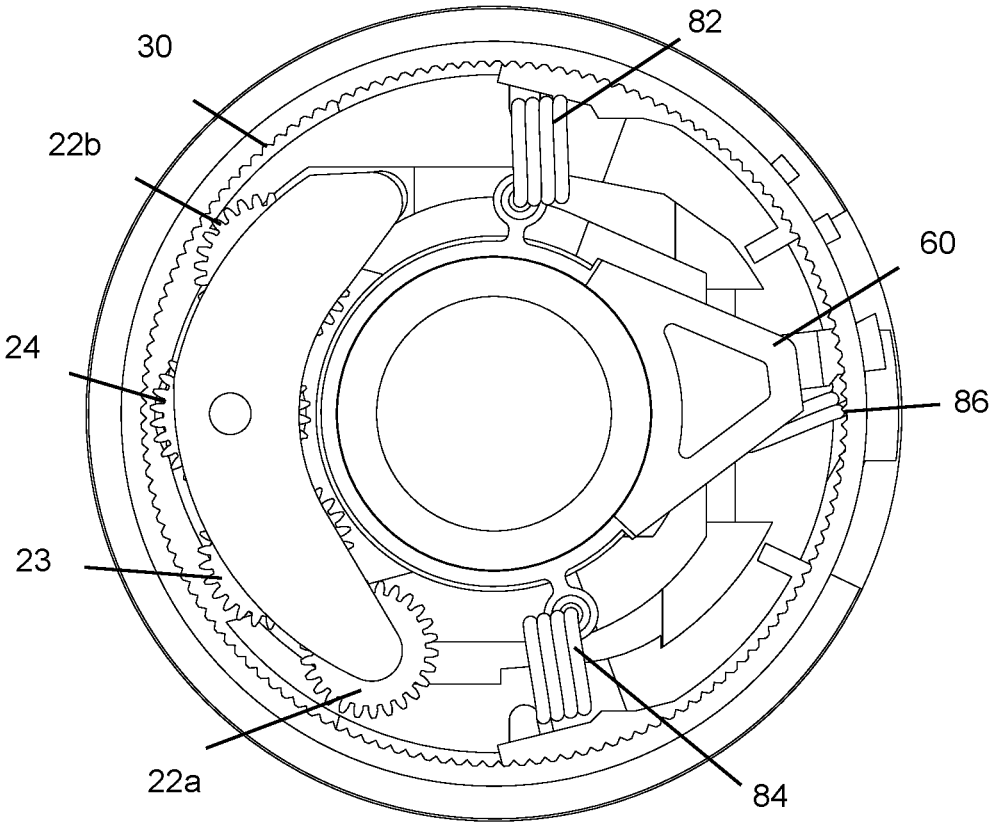
FIG. 9C illustrates the driving gears out of contact with the driving ring.
Figure 10:
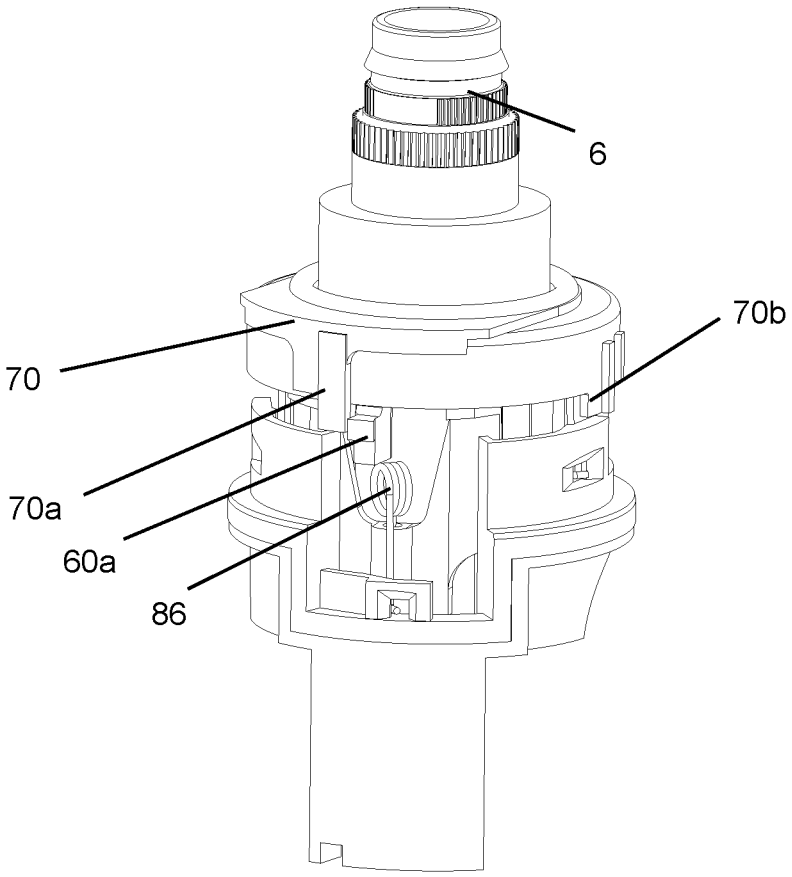
FIG. 10 illustrates a more detailed view of the interaction of the arc set ring and the toggle of the oscillating sprinkler assembly of FIG. 1 in accordance with an embodiment of the present application.

In embodiments, movement of the toggle 60 just over its center line will move the cage 22 from the first position to the second position and vice versa. That is, where the cage 22 is in its first position, application of force to the toggle to move it over its center line L-L (see FIGS. 9A and 9B) will move the cage to the second position. In embodiments, the toggle 60 may include a radial protrusion 60*a* that interacts with tab, or extension, 70*a* extending downward from the arc set ring 70. In embodiments the tab 70*a* is adjustable relative to stationary wall 70*b* to set a desired arc of rotation. As the output shaft 6 rotates, the tab 70*a* rotates with it. When the tab 70*a* contacts the protrusion 60*a*, it rotates toggle 60 and compresses spring 82 and 84. Once the protrusion is over the center line L-L, spring 82 and 84 expand which drives the toggle 60 and gear cage 22 from the first position (see FIG. 9A) to the second position (see FIG. 9B) to reverse the direction of rotation of the output shaft 6. Rotation in the reverse direction continues until the protrusion contacts the wall, or extension, 70*b*, which moves the toggle 60 back over the center line to again reverse the direction of rotation in a manner similar to that described above (see FIG. 10, for example). FIG. 9C illustrates the gear cage 22 between the first position and the second position.

In embodiments, all of the spring elements 82, 84 and 86 are embodied as torsion springs and structured substantially as indicated in FIG. 8. The use of three torsion springs provides added protection against the gear cage 22 hanging up between the first position and the second position. Torsion springs tend to be relatively inexpensive such that the use of three torsion springs reduces the overall cost of the sprinkler assembly 1 relative to other designs that may use omega-shaped springs such as those illustrated in assignee's U.S. Pat. No. 8,567,698, for example. The use of torsion springs also eliminates the likelihood that the spring will pop out of place, because the lateral protrusion P of the spring is locked by the notch 72, 74, 76. Further, torsion springs tend to last longer than omega shaped springs and other alternatives.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

What is claimed is:

1. An oscillating sprinkler comprising:

a sprinkler housing including an inlet for connection to a supply of water;

a nozzle assembly mounted in the sprinkler housing and configured to direct water out of the oscillating sprinkler, said nozzle assembly in fluid connection with the sprinkler housing;

an output shaft mounted in the sprinkler housing and connected to the nozzle assembly;

a drive assembly mounted in the sprinkler housing and connected to the output shaft to rotate the output shaft and the nozzle assembly;

the drive assembly including:

a movable gear cage;

a toggle connected to the movable gear cage for changing a direction of rotation of the output shaft;

a first drive gear mounted on a first side of the movable gear cage configured to rotate the nozzle assembly in a first direction and a second drive gear mounted on a second side of the movable gear cage and configured to drive the nozzle assembly in a second direction, opposite the first direction, the movable gear cage configured to hold the first drive gear in driving engagement with the output shaft in a first position until the second drive gear is moved into a second position where the movable gear cage is in driving engagement with the output shaft;

a pair of extensions rotatable with the output shaft and configured to engage the toggle and to move the movable gear cage to change the direction of rotation of the output shaft, and an over-center torsion spring positioned to bias the movable gear cage in at least one of the first position and the second position wherein the over-center torsion spring moves the movable gear cage toward the first position or the second position to prevent the movable gear cage from stalling in between the first position and the second position, the over-center torsion spring including:

a coil with a center axis, wherein the center axis of the coil extends in a direction substantially perpendicular to a central axis of the sprinkler housing; and a respective lateral projection extending laterally from a bottom portion thereof and configured to be received in a respective slot formed in a vertical tab extending substantially parallel to the central axis of the sprinkler housing.

2. The oscillating sprinkler of claim 1, further comprising:

first torsion spring provided on a first side of the over-center torsion spring;

a second torsion spring position on a second side of the over-center torsion spring, the first torsion spring and the second torsion spring biasing the movable gear cage into the first position when the first drive gear is engaged and into the second position when the second drive gear is engaged;

the first torsion spring including a first lateral projection formed on a bottom of the first torsion spring and the second torsion spring including a second lateral projection formed at a bottom of the second torsion spring, at least the first lateral projection of the first torsion spring and the second lateral projection of the second torsion spring extending into a first slot formed below a top surface of a gear cage support surface on which the movable gear cage moves.

3. The oscillating sprinkler of claim 1, wherein a position of at least one extension of the pair of extensions is adjustable to set an arc of rotation of the nozzle assembly.

4. The oscillating sprinkler of claim 3 wherein the arc of rotation is adjustable between 0 and 360 degrees.

5. The oscillating sprinkler of claim 1, wherein the output shaft comprises an inner ring with a plurality of teeth mounted thereon and the first drive gear and second drive gear engage the plurality of teeth to rotate the output shaft.

6. The oscillating sprinkler of claim 1, wherein the respective slot is formed below a top surface of the surface supporting the movable gear cage.

7. The oscillating sprinkler of claim 1, further comprising a turbine assembly mounted in the sprinkler housing and in fluid communication with the supply of water, the turbine assembly including a rotating shaft connected to the movable gear cage to provide for rotation of the output shaft.

8. The oscillating sprinkler of claim 7, wherein the movable gear cage further comprises a common gear connected to the rotating shaft of the turbine assembly and interacting with the first drive gear and the second drive gear.

9. An oscillating sprinkler comprising:

a sprinkler housing including an inlet connected to a supply of water;

a nozzle assembly configured to direct water out of the sprinkler;

an output shaft mounted in the sprinkler housing and connected to the nozzle assembly;

a movable gear cage mounted in the sprinkler housing and movably contacting the output shaft, the movable gear cage including:

a toggle configured to change a direction of rotation of the output shaft; and a first drive gear on one side of a center position and a second drive gear on a second side of the center position, the first and second drive gears alternately engageable with the output shaft in a first position and a second position to rotate the nozzle assembly in opposite directions, wherein both the first drive gear and the second drive gear are out of engagement with the output shaft when the movable gear cage is in a center position between the first position and the second position;

an over-center spring configured to bias at least one of the first drive gear and the second drive gear into engagement with the output shaft wherein the over-center spring moves the first drive gear toward the output shaft or the second drive gear toward the output shaft;

two extensions rotatable with the output shaft for contacting the toggle to change the direction of rotation of the output shaft and move the movable gear cage over its center position;

a first torsion spring provided on a first side of the over-center spring; and a second torsion spring position on a second side of the over-center spring, the first torsion spring and the second torsion spring biasing the movable gear cage into the first position when the first drive gear is engaged and into the second position when the second drive gear is engaged;

the first torsion spring including a first lateral projection formed at a bottom of the first torsion spring and the second torsion spring including a second lateral projection formed at a bottom of the second torsion spring, at least one of the first lateral projection of the first torsion spring and the second lateral projection of the second torsion spring extending into a first slot formed below a top surface of a gear cage support surface on which the movable gear cage moves; and the over-center spring including:

a coil with a center axis, wherein the center axis of the coil extends in a direction substantially perpendicular to a central axis of the sprinkler housing; and a respective lateral projection extending laterally from a bottom portion thereof and configured to be received in a respective slot formed in a vertical tab extending substantially parallel to the central axis of the sprinkler housing.

10. The oscillating sprinkler of claim 9, wherein the over-center spring is a torsion spring.

11. The oscillating sprinkler of claim 9, wherein a position of at least one extension of the two extensions is adjustable to set an arc of rotation of the nozzle assembly.

12. The oscillating sprinkler of claim 11, wherein the arc of rotation of the nozzle assembly is adjustable between 0 and 360 degrees.

13. The oscillating sprinkler of claim 9, wherein the output shaft comprises an inner ring with a plurality of teeth mounted thereon and the first drive gear and second drive gear engage the plurality of teeth to rotate the output shaft.

14. The oscillating sprinkler of claim 10, wherein the respective slot is formed below a top surface of the gear cage support surface supporting the movable gear cage.

15. The oscillating sprinkler of claim 9, further comprising a turbine assembly mounted in the sprinkler housing and in fluid communication with the supply of water, the turbine assembly including a rotating shaft connected to the movable gear cage to provide for rotation of the output shaft.

16. The oscillating sprinkler of claim 15, wherein the movable gear cage further comprises a common gear connected to the rotating shaft of the turbine and interacting with the first drive gear and the second drive gear.

* * * * *